United States Patent [19]

Gabbay et al.

[11] 4,292,563

[45] Sep. 29, 1981

[54] MULTIPLE CATHODE X-RAY TUBE FOR DENSITOMETERS

[75] Inventors: Emile Gabbay; Dang Tran Quang; André Lafitte, all of Paris, France

[73] Assignee: Compagnie Generale de Radiologie, Paris, France

[21] Appl. No.: 5,767

[22] Filed: Jan. 23, 1979

[30] Foreign Application Priority Data

Jan. 27, 1978 [FR] France ..... 78 02340

[51] Int. Cl.[3] ..... H01J 35/16; H01J 35/30

[52] U.S. Cl. ..... 313/56; 313/477 R; 313/413

[58] Field of Search ..... 313/56, 55, 409, 477, 313/416, 419

[56] References Cited

U.S. PATENT DOCUMENTS 2,638,554 5/1953 Bartow et al. ..... 313/56

4,057,745 11/1977 Albert ..... 313/55

FOREIGN PATENT DOCUMENTS 709728 of 1954 United Kingdom ..... 313/409

OTHER PUBLICATIONS

Electrical Review; May 26, 1897, p. 251, Swinton, "On the Design of X-ray Tubes."

*Primary Examiner*—Robert Segal

*Attorney, Agent, or Firm*—Roland Plottel

[57] ABSTRACT

A multiple cathode X-ray tube for densitometers.

This tube contains an anode assembly functioning by transmission, which is arranged along the sides of a regular convex polygon, with several cathodes, each of which sweeps one side of the polygon and a collimation device with several openings placed in front of the anode assembly to produce a series of fine, parallel and coplanar beams, the number of beams being equal to the number of openings. Such a tube makes very fast tomography possible.

9 Claims, 2 Drawing Figures

MULTIPLE CATHODE X-RAY TUBE FOR DENSITOMETERS

Figure 1:
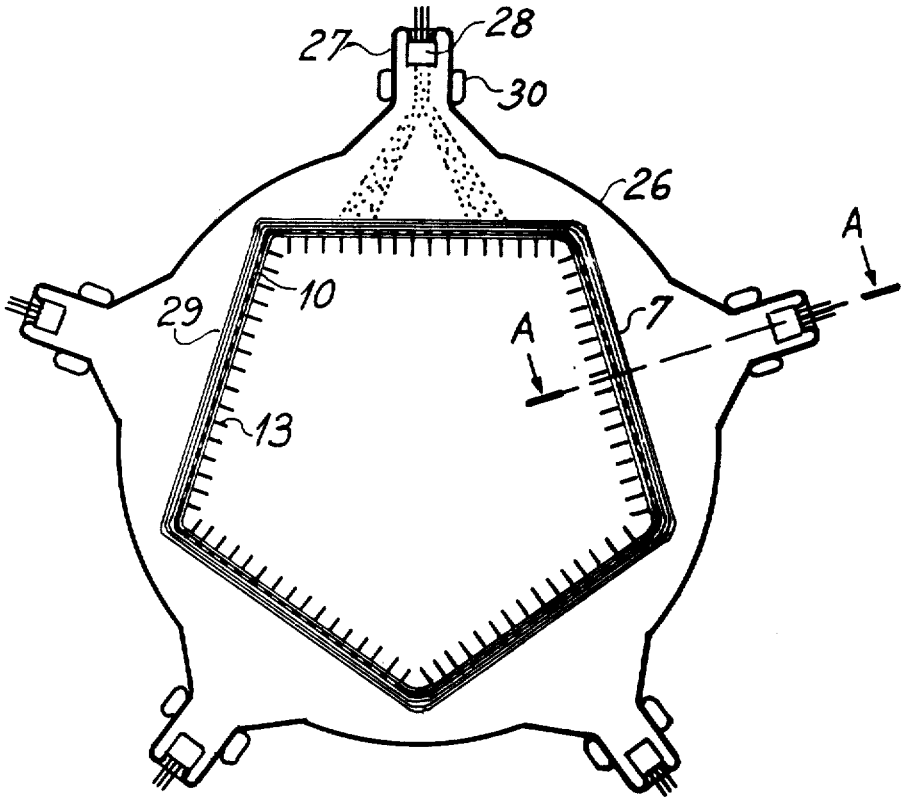

The present invention covers an X-ray tube intended more especially for a transverse axial tomography apparatus using a computer which is also called a tomodensitometer.

Originally, apparatuses of this type contained a source which emitted a fine ray of penetrating radiation in the direction of the section of the body to be examined and a detector arranged in such a way as to receive this radiation and measure its intensity afte it passed through the body. The source-detector assembly was subjected to a rectilinear movement perpendicular to the direction of the beam and then to a small angular rotation (about 1°) around an axis perpendicular to the examination plane and so on until the whole assembly had turned about 180°. Very long examination times were the result. These were troublesome for the patient and it was not possible to examine moving organs.

To correct this disadvantage, apparatuses were designed in which the rectilinear sweep movements were suppressed. The source emitted a fan-shaped beam of radiation, with a wide aperture in the section plane, which passed through the body and irradiated simultaneously several detectors placed side by side in this plane. The source-detector assembly is then only subjected to a rotational movement round the body. Such an apparatus is described for example in British Pat. No. 1 430 089 which is a division of the application filed on May the 17$^{th}$ 1972 under Ser. No. 23 064/72 by E.M.I. Limited.

An intermediate solution, described for example in French patent application Ser. No. 74.29537, published under No. 2 242 835 for the same company, consists in using a radiation source emitting a fan-shaped beam, with a smaller aperture than in the preceding case and a smaller number of detectors which are subjected to rectilinear movements and angular rotations equal to the beam aperture angle.

Still with the intention of reducing the examination time, in the case in which the rectilinear movement of the source is retained, suppression of the mechanical sweep has been considered with the use of an X-ray tube as radiation source which has an anode of elongated shape arranged in the direction of the rectilinear movement and swept by an electron beam so that the focal point, from which the fan-shaped beam is emitted, makes the lateral sweep movement with respect to the body. As in the case of the aforementioned British patent, a row of fixed detectors is arranged, sufficient in number to pick up all the rays emitted by the source during its movement. Such an apparatus is described for example in German Pat. No. P 25 38 517.5 filed by E.M.I. Limited.

Finally, to reduce or cut out the mechanical rotation of the source-detector assembly round the object to be examined, X-ray tubes were designed whose anode in the shape of an arc of a circle or a ring surrounds the object partly or completely. These tubes contain either a fixed cathode whose electron beam is deviated to sweep the anode (as described for example in French patent application Ser. No. 76.27368, published under No. 2 324 191 filed by NIHON DENSHI KABUSHIKI KAISHA) or a moving cathode mounted on a trolley (as described in French patent application Ser. No. 76.31251, published under No. 2 328 280 for E.M.I. Limited) or several fixed cathodes whose deviated beams sweep a corresponding part of the anode (as also described in the French patent application published under No. 2 328 280).

All these known apparatuses have common disadvantages in that they use fan-shaped radiation beams. Processing of the data supplied by the detectors for the construction of the image representing the distribution of the radiation absorption in the plane of the section examined is longer and more complicated than in the case in which the attenuation values of parallel radiation beams can be obtained directly irrespective of whether these data are recombined in groups or not corresponding to paths of parallel beams.

X-ray tubes, with a fixed or rotating anode, used in these apparatuses produce fan-shaped beams inside which the energy distribution varies widely. Also, the projection of the real focal point on the input surface of each of the detectors suffers distortion which increases with the angular deviation with respect to the centre ray of the beam, and the detectors at the ends of the row only receive a small part of the radiated energy.

Also, in an apparatus using a fan-shaped beam, all the detectors or several of them are irradiated simultaneously so that a detector may pick up diffused rays belonging originally to beams associated with other detectors in spite of the existence of the collimation device placed in front of these detectors and this results in noise at the image level.

The invention covers a fixed anode X-ray tube which enables the disadvantages mentioned above and others to be eliminated. It enables the mechanical linear sweep movement to be reduced and even eliminated in the case of objects of relatively small size (skull, breast).

With the X-ray tube in accordance with the invention a series of caplanar, separate parallel beams are produced which improves the spatial resolution of the apparatus (detection of sudden big density varations in the object); the beam intensity is sufficient not to affect the density resolution (differentiation of very similar densities) and, also, the beams are highly directional, which reduces the undesirable influence of the beam aperture existing in known apparatuses and making it necessary to introduce corrections at the calculation level thus increasing the data acquisition and/or calculation time.

In accordance with the invention, the X-ray tube is in the shape of a complete or part ring containing an assembly of cathodes distributed round the periphery of an envelope and is characterized by the fact that it contains, among other things:

an anode assembly operating by transmission, arranged along the sides of a regular convex polygon, each cathode being on the median line of one side of this polygon, a collimation device with several openings placed in front of the anode assembly to produce a series of fine X-ray beams, which are roughly parallel and coplanar, when the electron beams emitted by the cathodes sweep the anode assembly, each beam sweeping one side of the polygon thanks to a deviation system, the number of beams being equal to the number of openings in the collimation device.

Figure 2:
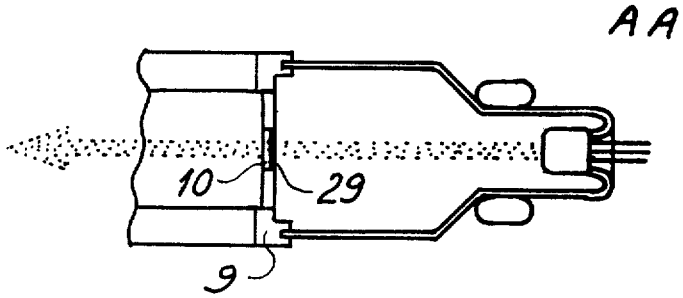

Other advantages and characteristics of the invention will be shown up in the following description which is given as a non-limiting example and is illustrated by the figures in the appendix showing:

in FIG. 1, a multiple cathode tube with an anode in the shape of a polygon in accordance with the invention, in FIG. 2, a sectional view along line A—A in FIG. 1.

FIG. 1 shows a way of making the tube in the form of a complete ring.

This tube has an envelope 26 of insulating material, fitted with several collars 27 in which are arranged cathodes 28. Opposite these are placed flat anodes 29 in front of which are collimation devices 10 and 13.

Each of these anodes 29 consists of a target 7 formed by a thin, X-ray emitting layer between 2 and 10μ thick made of a refractory material with a high atomic number such as tungsten or platinum; this layer is deposited by a known method, i.e. electronic bombardment, electrolytic deposition, deposition in the vapour state, on a subtrate formed by a thin sheet between 0,5 and 1 mm thick made from a material which is highly permeable to X-rays such as beryllium or aluminium.

These anodes are arranged along the sides of a regular convex polygon the number of whose sides may be even or odd; preferably an odd number of sides is used; however, when certain corrections such as beam aperture corrections are to be made, an even number of sides enables absorption values for opposing beams to be obtained at the same time.

In a particular way of making the assembly, the anodes are formed by independant elements connected to one another at the tips of the polygon. In a variant, the anodes are formed on a monoblock substrate of polygonal shape. polygonal shape.

Cooling is provided by one or several circuits which enable a cooling fluid to be passed in front of the different anodes, this system not being shown in the figures.

Each cathode is associated with a beam deviation device 30 of the electromagnetic or electrostatic type so that it sweeps the corresponding anode.

It may be noted that the number of sides of the polygon should not be too big because it must be arranged that the X-ray beams explore the object to be examined.

On the rear surface of the substrate supporting the anode target, a collimation device 10 is provided whose openings may be formed by slots made in block 9 which holds the substrate and is joined to the envelope with a seal as shown in FIG. 2. These openings may also be formed by spaces produced by bars aligned in the transverse direction of the target.

This collimation device may be made of any material highly absorbant of X-rays and of high atomic number, in particular alloys containing tungsten. In this case, it is not advisable to use lead because it is not hard enough. This collimation device, when the target is swept by electronic beams, enables a series of fine beams to be obtained which are roughly parallel and coplanar.

The sealing of a sheath (not shown) at its lower end may be done by a window whose purpose is also to absorb low energy X-rays and which consists, for example, of an aluminium sheet 2 mm thick of the polygonal shape of the anode. A second collimation device 13 is also provided, which consists of parallel sheets made of a material which absorbs X-rays. Some fifteen possible beams per polygon side are shown in the figure but this number may be much higher.

In a preferred way of making the invention, the anode target is not deposited on the whole substrate surface but is in the form of parallel strips which are turned perpendicularly to the direction of the electron beam sweep. They are made by deposition using a mask.

The way of using such an X-ray tube is very variable. The cathodes may be controlled simultaneously or in succession. Also, the system enables the number of levels of rotation to be considerably reduced. Thus it is possible to bombard the whole surface of the object to be examined over 360° in a relatively short time.

The present invention is in no way limited to the mode of production described and shown. Many variants are accessible to the professional depending on the applications proposed and without going outside the field of the invention.

For example, each anode or part of an anode 29 can be swept simultaneously by several electron beams to obtain several parallel X-ray beams at once. The examination time is thus divided by the number of beams. In order to retain the advantage concerning diffused radiation, a sufficient spacing between electron beams must be used. A wider electron beam may also be used to give several nearby X-ray beams simultaneously.

What is claimed is:

1. An X-ray tube, for tomodensitometers in particular, containing:

an envelope (26) in the form of a ring, fitted with collars (27) in which cathodes (28) are placed, an anode assembly functioning by transmission which is arranged along the sides of a regular convex polygon, each cathode being on the median line of one side (29) of this polygon, a beam deviation device (30) associated with each cathode (28) for sweeping the relating side of the polygon, a collimation device (10) with several openings placed in front of the anode assembly to produce a series of fine X-ray beams which are roughly parallel and coplanar when the electron beams emitted by the cathodes (28) sweep the anode assembly, the number of beams being equal to the number of openings in the collimation device (10).

2. An X-ray tube as claimed in claim 1, wherein the anode assembly is formed by several anodes each coinciding with one side (29) of the polygon and being joined mechanically one to another to the tips of the polygon, each anode being formed of a thin target of X-ray emitting refractory material deposited on a support of rectangular plane shape, which is lengthened in the direction of sweep of the corresponding electron beam and absorbs very little the X-rays emitted by the target.

3. An X-ray tube as claimed in claim 1, wherein the anode assembly is formed by a thin target of X-ray emitting refractory material deposited on a monoblock support of material which absorbs only slightly the X-rays emitted by the target and is in the shape of a convex polygon.

4. An X-ray tube as claimed in claim 2, wherein the support is covered over all its surface with the refractory material forming the target.

5. An X-ray tube as claimed in claim 2, wherein the support is covered, in the form of parallel strips turned perpendicularly to the electron beam sweep plane and placed opposite the collimation device apertures (10), by the refractory material forming the target.

6. An X-ray tube as claimed in claim 2 or 3, wherein the thickness of the target is between 2 and 10μ.

7. A tomodensitometer containing one or several X-ray tubes as claimed in claim 1.

8. An X-ray tube as claimed in claim 3 wherein the supports are covered over all their surface with the refractory material forming the targets.

9. An X-ray tube as claimed in claim 3 wherein the supports are covered, in the form of parallel strips truned perpendicularly to the electron beam sweep plane and placed opposite the collimation device apertures (10), by the refractory material forming the targets.

* * * * *